US006083117A

United States Patent [19]

Hsu

[11] Patent Number: 6,083,117

[45] Date of Patent: Jul. 4, 2000

[54] GOLF CLUB HEAD

[76] Inventor: Tsai-Fu Hsu, No. 386, Liao Ning 1st Street, San Min District, Kaohsiung, Taiwan

[21] Appl. No.: 09/203,738

[22] Filed: Dec. 2, 1998

[51] Int. Cl.[7] ..... A63B 53/04

[52] U.S. Cl. ..... 473/332; 473/340; 473/342

[58] Field of Search ..... 473/324, 342, 473/329, 332, 340, 251

[56] References Cited

U.S. PATENT DOCUMENTS 3,975,023 8/1976 Inamori .
5,398,929 3/1995 Kitaichi .
5,419,419 5/1995 Anderson .
5,431,396 7/1995 Shieh .
5,536,006 7/1996 Shieh .
5,816,936 10/1998 Aizawa .

*Primary Examiner*—Sebastiano Passaniti
*Attorney, Agent, or Firm*—Rosenberg, Klein & Lee

[57] ABSTRACT

A golf club head has a recess in a striking face and annular groove formed around the recess. A metal layer is fitted in the recess and an annular resin layer is formed in the annular groove to surround the metal layer. Then preparatory work for plating the whole head can be done quickly, and club heads after treated with plating may be of excellent quality, resulting in lower cost.

1 Claim, 4 Drawing Sheets

GOLF CLUB HEAD

BACKGROUND OF THE INVENTION

This invention relates to a golf club head, particularly to one having a striking face of excellent quality and convenient for manufacturing so as to reduce its cost.

In designing a golf club head, the main consideration is its excellent effect in hitting a golf ball. As far as a putter is concerned, it is utilized to hit a golf ball to a desired location smoothly. Therefore, the golf club head of the putter has a large influence on acquiring excellent hitting effect. A known conventional golf club head shown in FIG. 4 includes a striking face 100, a recess 101 formed under the striking face 100, a resin layer 11 formed in the recess 101 by filling resin material therein. Then an outer surface Ill (also forming a large part of the striking face 100 of the resin layer 11) is ground flush with the striking face 100, and the golf club head is to be wholly plated. But the outer surface 111 of the resin layer 11 is not plated so that the whole striking face 100 is formed by different materials.

As to the golf club head is requested to have high quality, a metal layer 12 is fitted in the recess 101 instead of the resin layer 11, as shown in FIG. 5. Then the outer surface 121 (also forming a large part of the striking face 111) of the metal layer 12 is ground flush with the striking face 100. The outer surface 121 of the metal layer 12 has to be covered with an anti-acid and anti-alkali oil paper or an adhesive tape before the club head is treated with plating. Further, the dimensions of the oil paper or the adhesive tape should be the same as that of the outer surface of the metal layer 12, and be adhered just thereon, taking much time and work. Should the oil paper or the adhesive tape be adhered a little improperly, plating substance may percolate in the outer surface 121 to make it sloped. Then the outer surface 121 may not be flush with the striking face 100, resulting in lots of unqualified products. Though golf club heads with the metal layer appear good-looking, it absorbs vibration less than that with a resin block.

SUMMARY OF THE INVENTION

This invention has been devised to offer a kind of golf club head provided with a recess in the striking face for fitting a metal layer therein and with an annular resin layer around the metal layer. Then a preparatory work can be processed quickly before the culb head is treated with plating, and it may have an excellent quality after plating, reducing its manufacturing cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
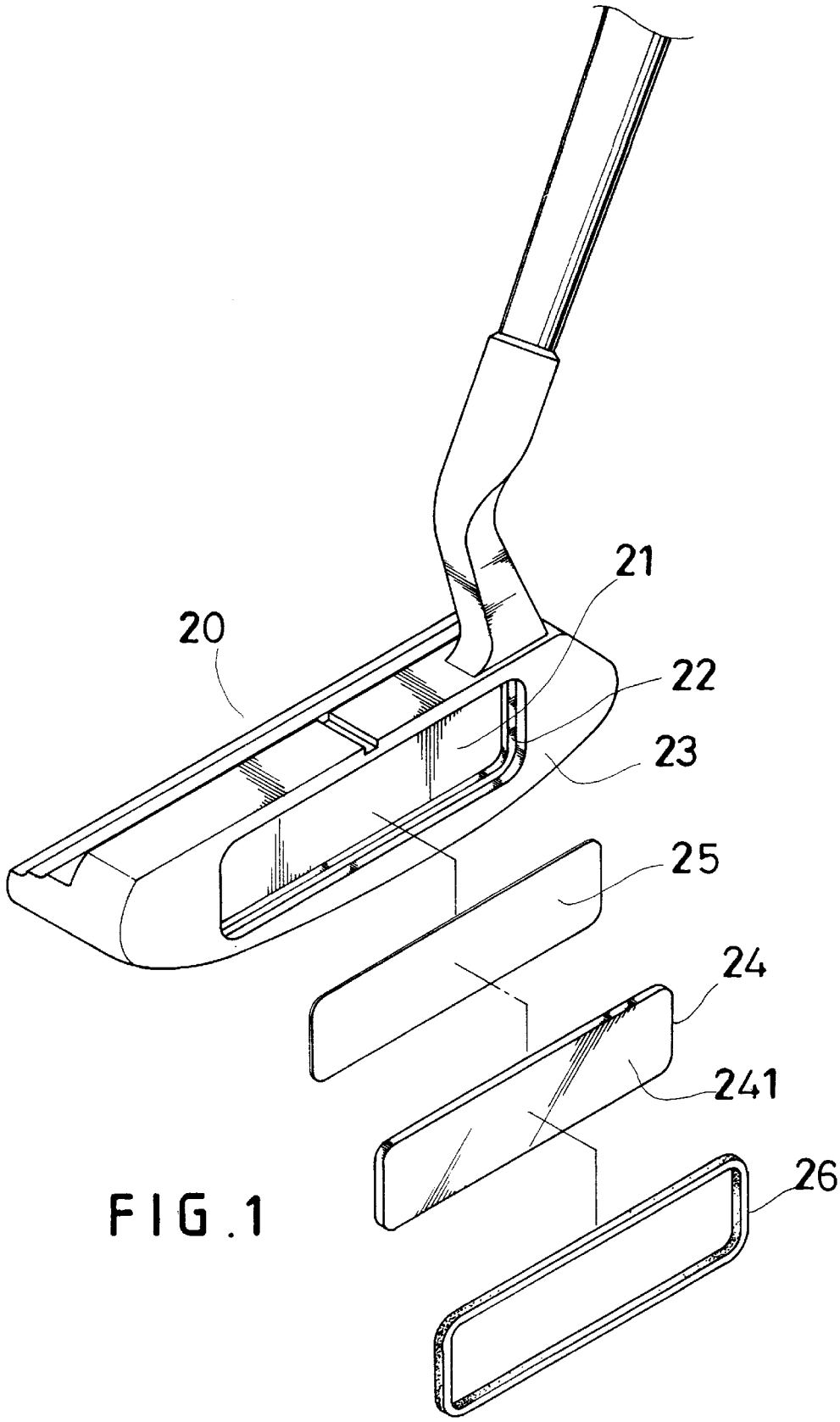
FIG. 1 is an exploded perspective view of a golf club head of the present invention.

A preferred embodiment of a golf club head of the present invention, as shown in FIG. 1, includes a head body 20, a striking face 23 formed in a front side of the head body 20, a recess 21 formed in the striking face 23, an annular groove 22 formed around the annular wall of the recess 21, a metal layer 24 fitted in the recess 21, a glue layer 25 fitted behind (inside) the metal layer 24 to adhere the inner side of the metal layer 24 tightly in the recess 21. Then resin, preferably epoxy, is then filled with the annular groove 22, forming a resin layer 26 around the metal layer 24 and locating between the striking face 23 and the metal layer 24.

Figure 2:
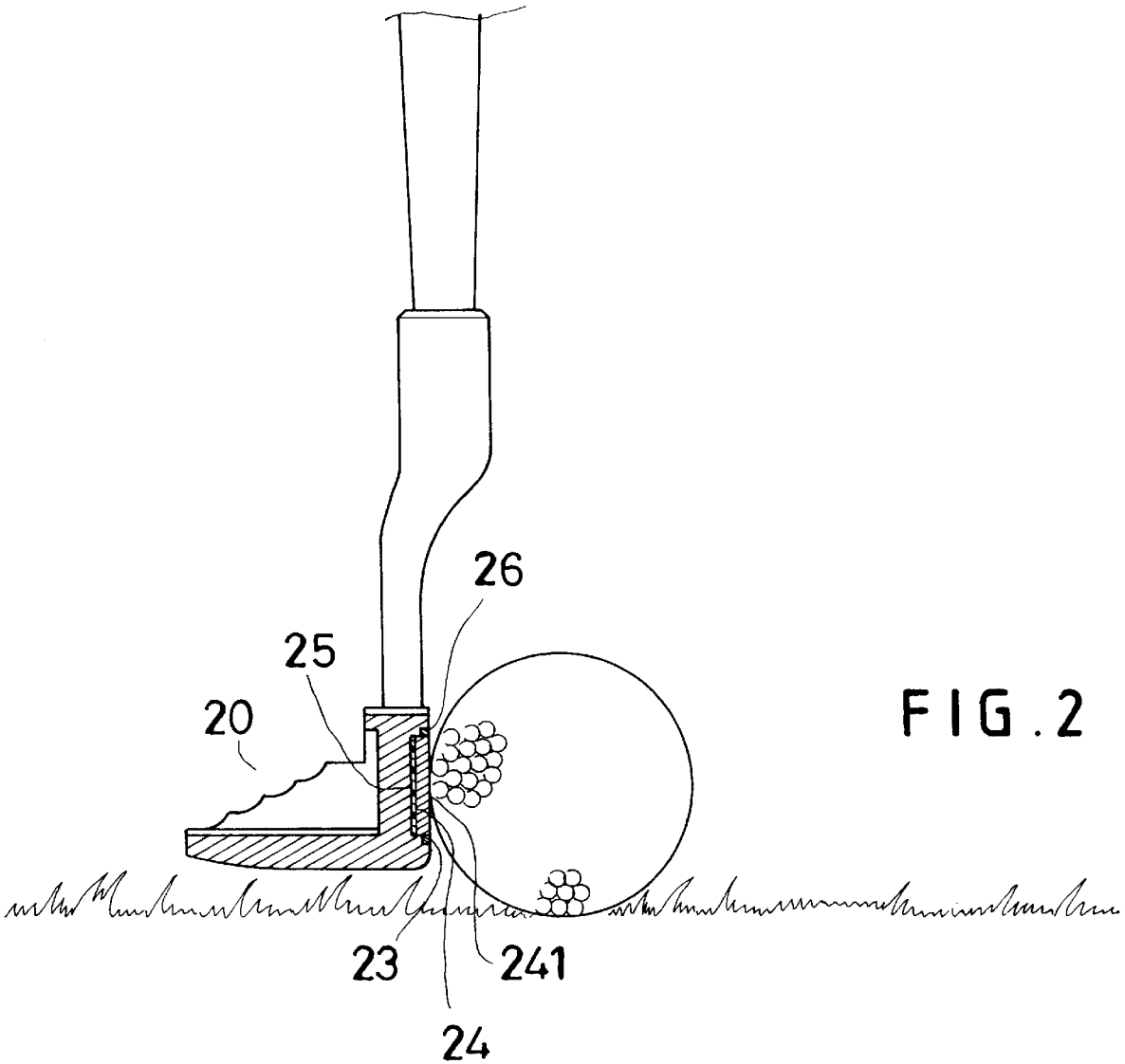
FIG. 2 is cross-sectional view of the golf club head of the present invention.

Next, referring to FIG. 2, the glue layer 25 is first coated in the deepest portion of the recess 21 and then the metal layer 24 is fitted in the recess 21 on the glue layer 25 to adhere to the inner side of the metal layer 24, and then the resin layer 26 is formed between the metal layer 24 and the striking face 23 with the metal layer 24 tightly stabilized therein. Then the metal layer 24 and the resin layer 26 are ground flush with the striking face 23 and the whole club head 20 is treated with plating. However, an anti-acid and anti-alkali oil paper or an adhesive tape of the same dimensions as the outer surface 241 of the metal layer 24 has to be adhered just on the metal layer 24 before the whole head 20 is treated with plating. As to the dimensions of the oil paper or the adhesive tape, it can be made a little larger than the outer surface 241 of the metal layer 24 and a little smaller than that of the resin layer 26 so that the plating substance may not be adhere to the resin layer 26 to harm it. And the plating substance cannot affect the resin layer 26, even if it adheres to the resin layer 26. Thus, in adhering the oil paper or the adhesive tape, workers do not need to worry about fitting it just on the metal layer 24 and unqualified products may decrease.

Figure 3:
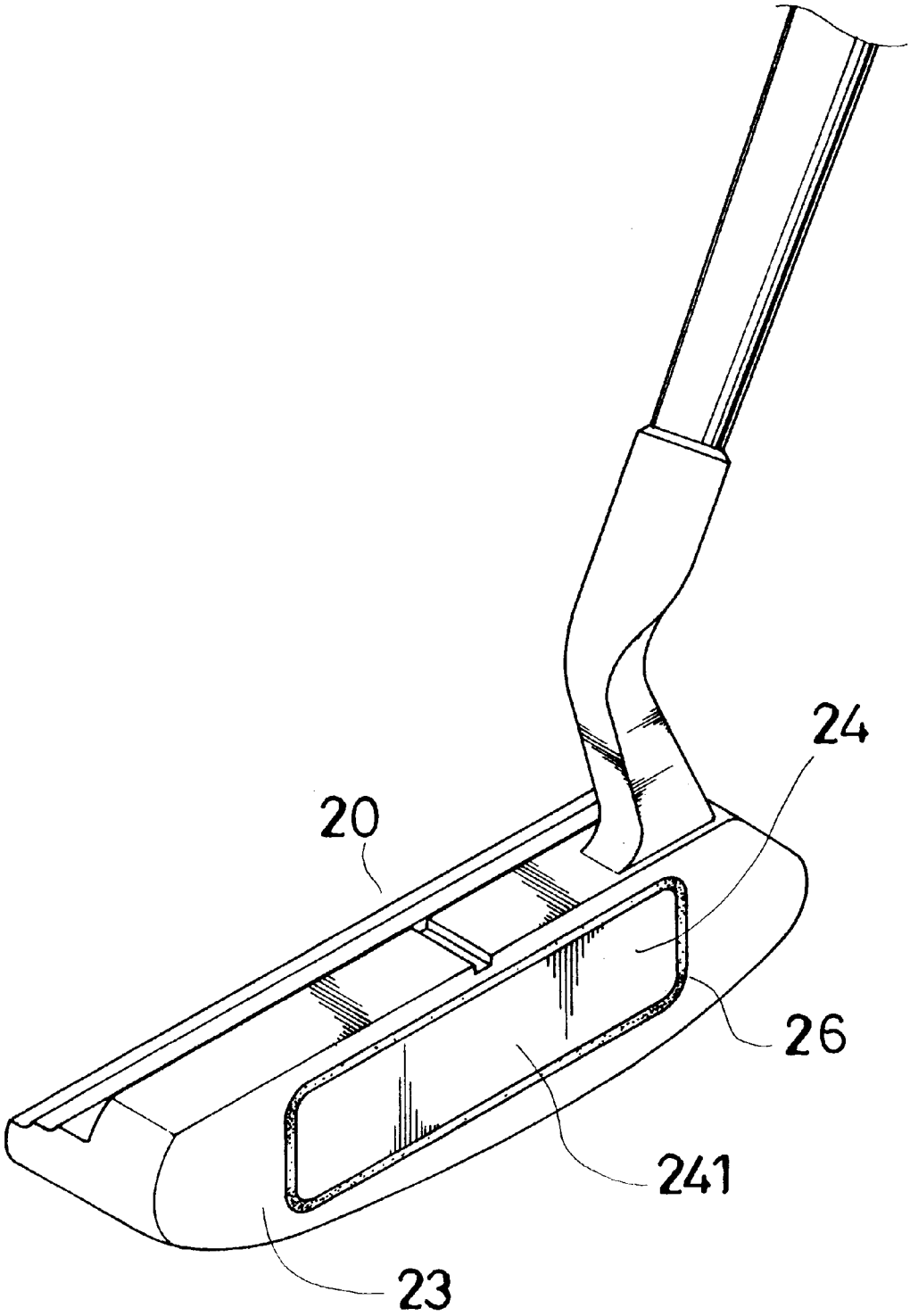
FIG. 3 is a perspective view of the golf club head of the present invention.
Figure 4:
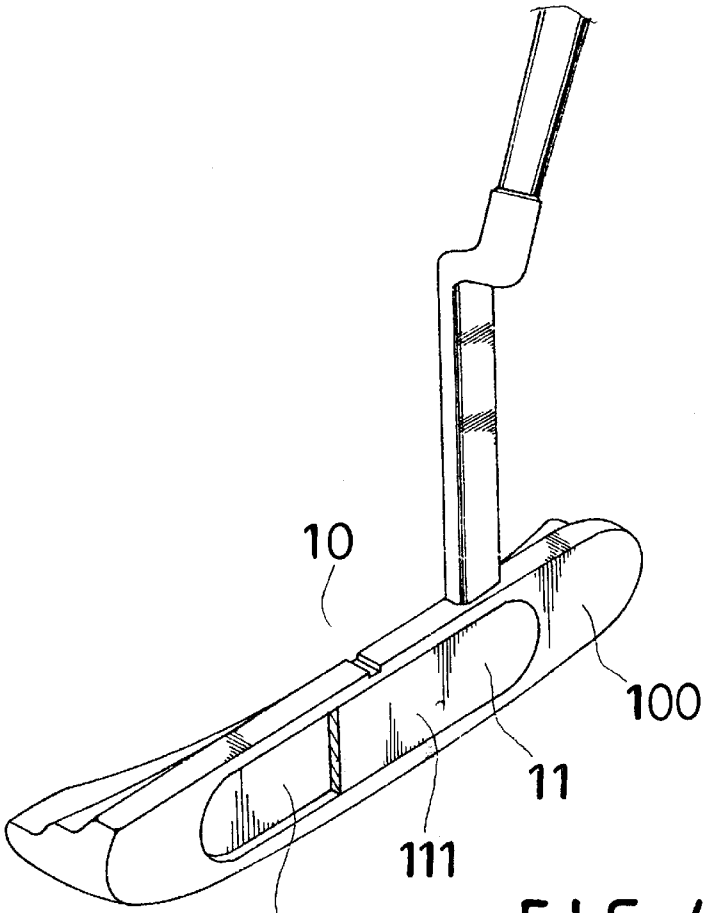
FIG. 4 (PRIOR ART)
FIG. 4 is a perspective view of a known conventional golf club head.
Figure 5:
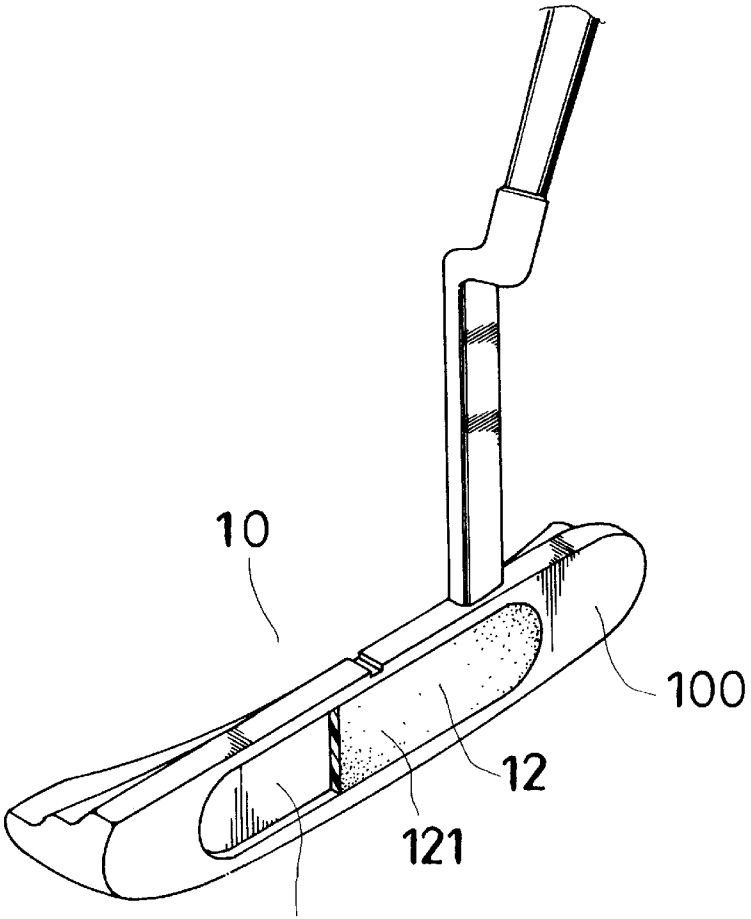
FIG. 5 (PRIOR ART)
FIG. 5 is a perspective view of another known conventional golf club head.

The club head of the invention has the metal layer 24 surrounded by the annular resin layer 26 and adhered with the glue layer 25 behind it, so when hitting a golf ball as shown in FIG. 3, vibration received by the outer surface 241 of the metal layer 24 may be transmitted to and absorbed by the glue layer 25 and the resin layer 26, permitting a user feel very little vibration at the instant when the ball is hit.

As can be seen from the above description, the golf club head of the invention has the following advantages.

1. The glue layer 25 and the annular resin layer 26 can absorb a large part of vibration caused by hitting a golf ball.

2. The provision of the annular resin layer 26 around the metal layer 24 can enhance work effect of workers in adhering an oil paper or an adhesive tape before plating process of the whole club head 20.

3. The annular resin layer 26 may be colored with various colors in contrast with the metal layer 24, letting the striking face 23 appear various visual effect.

What is claimed is:

1. A golf club head, comprising:

a head body having a striking face with a recess formed therein, said recess having a bottom surface bounded by a perimeter wall, said perimeter wall having an annular groove formed therein and spaced from said bottom surface, said annular groove being open to said striking face;

a metallic plate member disposed in said recess;

an adhesive disposed in a first space between said bottom surface of said recess and a rear surface of said metallic plate member to bond said metallic plate member to said head body; and, a resin disposed in a second space defined between said annular groove and a perimeter edge of said metallic plate member, said resin filled second space being non-contiguous with said first space.

* * * * *